US012055297B2

(12) United States Patent
Boardman et al.

(10) Patent No.: US 12,055,297 B2
(45) Date of Patent: Aug. 6, 2024

(54) TRAPPED VORTEX COMBUSTOR AND METHOD FOR OPERATING THE SAME

(71) Applicant: General Electric Company, Schenectady, NY (US)

(72) Inventors: Gregory Allen Boardman, Owens Cross Roads, AL (US); Michael Anthony Benjamin, Cincinnati, OH (US); Clayton Stuart Cooper, Loveland, OH (US); Joseph Zelina, Waynesville, OH (US); Eric John Stevens, Mason, OH (US)

(73) Assignee: GENERAL ELECTRIC COMPANY, Cincinnati, OH (US)

( * ) Notice: Subject to any disclaimer, the term of this patent is extended or adjusted under 35 U.S.C. 154(b) by 153 days.

(21) Appl. No.: 17/358,377

(22) Filed: Jun. 25, 2021

(65) Prior Publication Data

US 2021/0317990 A1 Oct. 14, 2021

Related U.S. Application Data

(62) Division of application No. 15/709,958, filed on Sep. 20, 2017, now Pat. No. 11,073,286.

(51) Int. Cl.

| | |
|---|---|
| ***F23R 3/34*** | (2006.01) |
| ***F23R 3/18*** | (2006.01) |
| ***F23R 3/52*** | (2006.01) |
| ***F23R 3/58*** | (2006.01) |
| *F23C 9/00* | (2006.01) |
| *F23R 3/12* | (2006.01) |

(52) U.S. Cl.

CPC ..... *F23R 3/34* (2013.01); *F23R 3/18* (2013.01); *F23R 3/52* (2013.01); *F23R 3/58* (2013.01); *F23C 9/006* (2013.01); *F23R 3/12* (2013.01); *F23R 3/346* (2013.01); *F23R 2900/00015* (2013.01)

(58) Field of Classification Search

CPC .... F23R 2900/00015; F23R 3/18; F23R 3/52; F23R 3/58

See application file for complete search history.

(56) References Cited

U.S. PATENT DOCUMENTS 4,045,956 A 9/1977 Markowski et al.
4,545,196 A 10/1985 Mongia et al.
(Continued)

*Primary Examiner* — Katheryn A Malatek
*Assistant Examiner* — Alyson Joan Harrington
(74) *Attorney, Agent, or Firm* — Venable LLP; Griffin A. A. Deadwick; Michele V. Frank

(57) ABSTRACT

Various embodiments include a trapped vortex combustor and a method for operating trapped vortex combustor. In one embodiment, the trapped vortex combustor comprises a trapped vortex combustion zone and at least one secondary combustion zone disposed downstream of the trapped vortex combustion zone. The trapped vortex combustion zone is operable to receive and combust a first fuel and a first air and produce a first combustion product flowing toroidally therein. The at least one secondary combustion zone is operable to receive and combust the first combustion product and at least one second injection consisting of fuel and/or air and produce at least one second combustion product therein. The combustor may reduce the residence time of the highest temperature combustion products and achieve the lower NOx emission.

13 Claims, 6 Drawing Sheets

(56) References Cited

U.S. PATENT DOCUMENTS

| | | | | |
|---|---|---|---|---|
| 4,702,073 | A | 10/1987 | Melconian | |
| 4,996,838 | A | 3/1991 | Melconian | |
| 5,165,226 | A | 11/1992 | Newton | |
| 5,406,799 | A | 4/1995 | Marshall | |
| 5,619,855 | A * | 4/1997 | Burrus | F23R 3/20 60/737 |
| 6,058,710 | A | 5/2000 | Brehm | |
| 7,260,936 | B2 | 8/2007 | Patel | |
| 7,942,006 | B2 | 5/2011 | Critchley | |
| 8,272,219 | B1 | 9/2012 | Johnson | |
| 8,776,525 | B2 | 7/2014 | Oechsle | |
| 9,222,674 | B2 | 12/2015 | Cunha | |
| 2004/0103663 | A1 | 6/2004 | Haynes et al. | |
| 2005/0144956 | A1 | 7/2005 | Alkabie | |
| 2008/0083224 | A1 | 4/2008 | Varatharajan et al. | |
| 2010/0058732 | A1 | 3/2010 | Kaufmann et al. | |
| 2013/0019604 | A1 * | 1/2013 | Cunha | F23N 5/16 60/737 |
| 2015/0323184 | A1 * | 11/2015 | Tangirala | F04D 29/544 60/754 |
| 2016/0201918 | A1 | 7/2016 | Jella et al. | |
| 2017/0050242 | A1 | 2/2017 | Melton | |

* cited by examiner

TRAPPED VORTEX COMBUSTOR AND METHOD FOR OPERATING THE SAME

CROSS REFERENCE TO RELATED APPLICATIONS

This application is a divisional application of U.S. Non-Provisional application Ser. No. 15/709,958 filed Sep. 20, 2017, the entire disclosure of which is incorporated herein by reference in its entirety.

FIELD

Embodiments of the disclosure relate generally to a gas turbine engine combustor, and more particularly to a combustor having a trapped vortex combustion zone and at least one secondary combustion zone.

BACKGROUND

In a conventional gas turbine engine, compressed air exiting from a compressor is mixed with fuel in a combustor. The mixture is combusted in the combustor to generate a high pressure, high temperature gas stream, referred to as a post combustion gas or product. The post combustion gas is expanded in a turbine, which converts thermal energy associated with the post combustion gas to mechanical energy that rotates a turbine shaft. The post combustion gas exits the turbine as an expanded combustion gas.

Among the challenges to improve combustor efficiency include efficient mixing of fuel and air and stabilization of the resulting flame. One of the means for addressing these challenges is inclusion of a trapped vortex (TV) cavity located upstream of the combustor, which forms a TV combustor and makes combustion or the flame more stable. Fuel is injected into the TV cavity from certain fixed points within the TV cavity. A portion of the air entering the combustor is diverted towards the TV cavity, which as the name suggests, traps the portion of the air into forming a vortex. However, the present TV combustor doesn't further comprise any downstream (or aft) fuel introduction stage downstream of the TV cavity.

The TV cavity is very stable over a large AFR (air fuel ratio) range for good ignition and low load operability, but it has a NOx penalty associated with the longer inherent residence time at full-load/throttle conditions. Furthermore, the TV cavity may be over-loaded in temperature and volumetric heat release as the engine (and combustor) goes up in load.

It is desirable to achieve lower NOx emission levels. The present disclosure aims to achieve lower NOx emission levels.

SUMMARY/BRIEF DESCRIPTION OF THE DISCLOSURE

In accordance with one aspect of an exemplary embodiment, a trapped vortex combustor is provided. The combustor comprises a trapped vortex combustion zone and at least one secondary combustion zone. The trapped vortex combustion zone is operable to receive and combust a first fuel and a first air and produce a first combustion product flowing toroidally therein. The at least one secondary combustion zone is disposed downstream of the trapped vortex combustion zone, and operable to receive and combust the first combustion product and at least one second injection consisting of fuel and/or air and produce at least one second combustion product therein.

In accordance with one exemplary embodiment, a method for operating a trapped vortex combustor is provided. The method comprises: directing a first fuel and a first air into a trapped vortex combustion zone of the combustor; combusting the first fuel and the first air in the trapped vortex combustion zone and producing a first combustion product flowing toroidally therein; directing the first combustion product and at least one second injection consisting of fuel and/or air into at least one secondary combustion zone of the combustor disposed downstream of the trapped vortex combustion zone; combusting the first combustion product and the at least one second injection consisting of fuel and/or air in the at least one secondary combustion zone and producing at least one second combustion product therein; directing the at least one second combustion product towards a combustor exit of the combustor for discharging out of the combustor.

It should be understood that the brief description above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
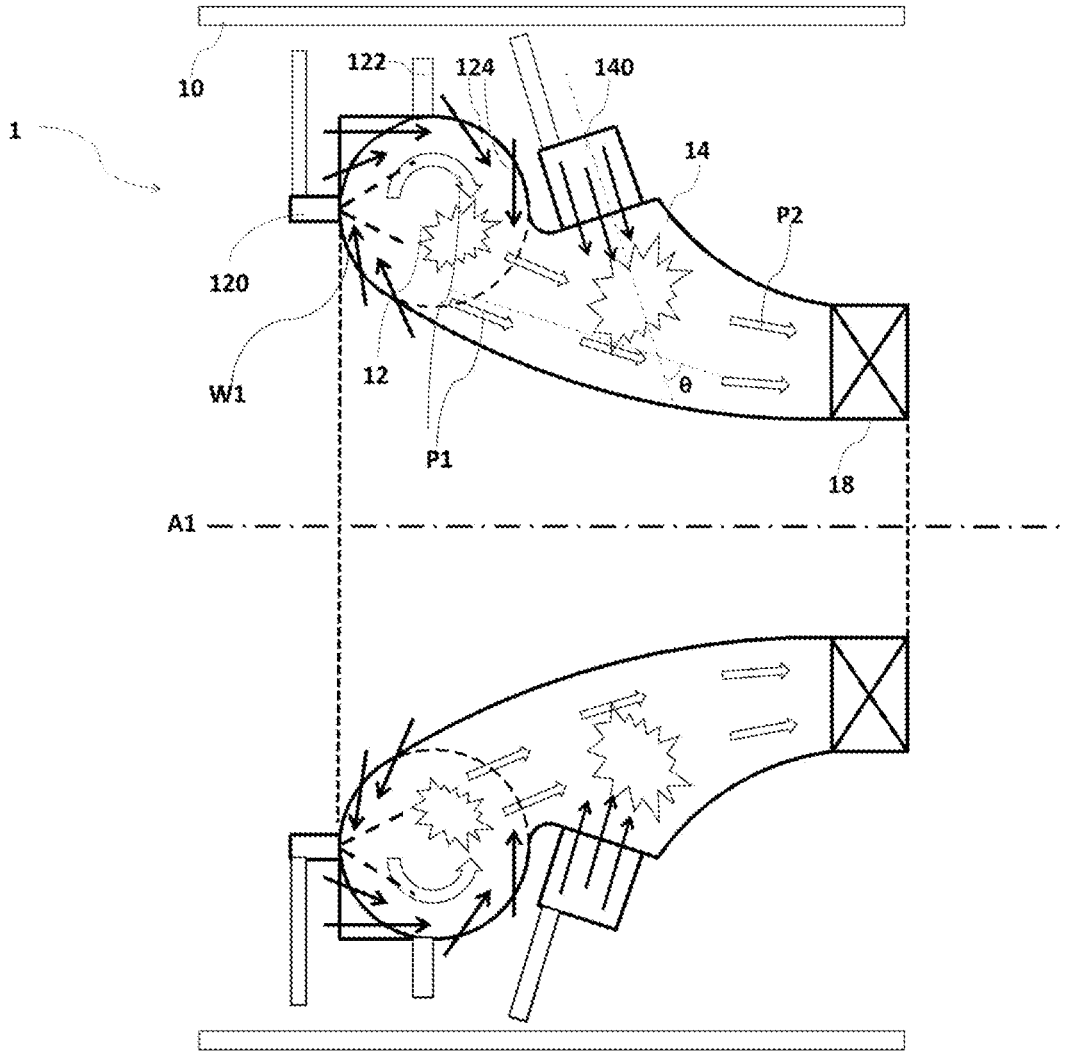
FIG. 1 is a schematic longitudinal cross-sectional diagram of a trapped vortex combustor in accordance with an embodiment of the disclosure.

Reference will now be made in detail to present embodiments of the disclosure, one or more examples of which are illustrated in the accompanying drawings. The detailed description uses numerical and letter designations to refer to features in the drawings. Like or similar designations in the drawings and description have been used to refer to like or similar parts of the disclosure.

As used herein, the terms "first", "second", "third" and "fourth" may be used interchangeably to distinguish one component from another and are not intended to signify location or importance of the individual components. The terms "upstream," "downstream," "radially," and "axially" refer to the relative direction with respect to fluid flow in a fluid pathway. For example, "upstream" refers to the direction from which the fluid flows, and "downstream" refers to the direction to which the fluid flows. Similarly, "radially" refers to the relative direction substantially perpendicular to the fluid flow, and "axially" refers to the relative direction substantially parallel to the fluid flow. The modifier "about" used in connection with a quantity is inclusive of the stated value and has the meaning dictated by the context (e.g., includes the degree of error associated with measurement of the particular quantity).

Figure 5:
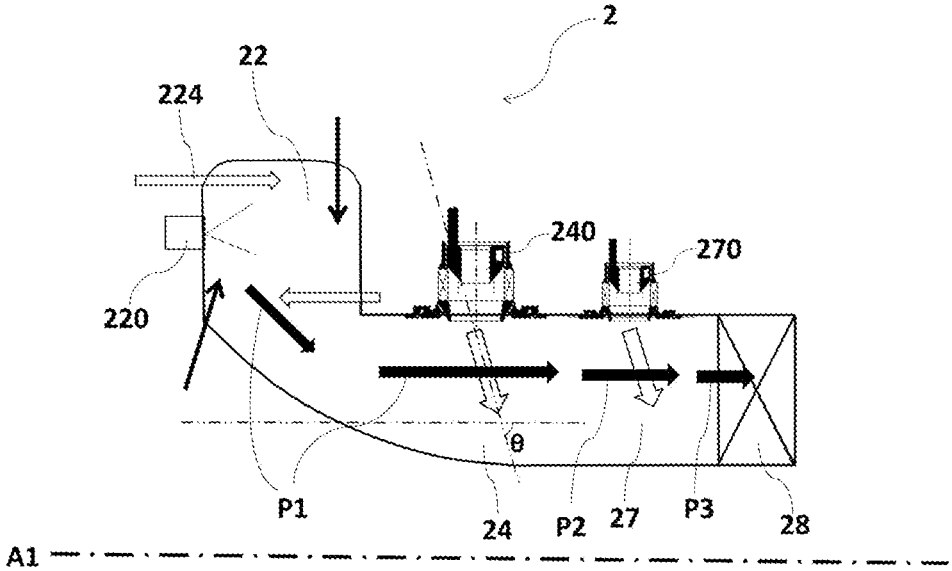
FIG. 5 is a schematic longitudinal partial cross-sectional diagram of a trapped vortex combustor in accordance with an embodiment of the disclosure.

FIG. 1 shows an exemplary embodiment of a trapped vortex (TV) combustor 1, and the combustor may be included within a gas turbine engine disclosed herein. The combustor 1 comprises a trapped vortex (TV) combustion zone 12, a secondary combustion zone 14 and a combustor exit 18, the TV combustion zone 12 also may be called as "a primary TV combustion zone". The secondary combustion zone 14 is disposed downstream of the TV combustion zone 12 substantially in axial direction and optionally in radial direction. In an exemplary embodiment, the combustor may comprise at least one tertiary combustion zone disposed downstream of the secondary combustion zone, as illustrated in FIG. 5, wherein a tertiary combustion zone is disposed downstream of the secondary combustion zone. In other exemplary embodiments, the combustor further comprises more than two downstream combustion zones downstream of the TV combustion zone.

In order to simplify illustration and description, only the upper half portion of the combustor 1 in FIG. 1 is indicated by reference numbers and described specifically accordingly, the opposite lower half portion could be understood totally by reference to the illustration and description of the upper half portion, since the combustor 1 is substantially symmetrical about a longitudinal axis A1 of the gas turbine. The similar simplification is made for the other illustrations and descriptions as below.

In an exemplary embodiment, the combustor 1 comprises an annular combustor that is shaped as generally annular about the longitudinal axis A1 of the gas turbine, such that the TV combustion zone 12, the secondary combustion zone 14 and the tertiary combustion zone and the other downstream (or aft) combustion zone(s) may all be shaped as annular. The TV combustion zone 12 may be formed or shaped as a trapped vortex (TV) combustion cavity in various embodiments. A combustor casing 10 is positioned around the combustor for providing support or protection and the like.

As illustrated in FIG. 1, the upper half portion and the lower half portion of the TV combustion zone 12 are both configured as substantially circular in longitudinal cross-section and each comprises a side wall W1, at least one pilot fuel nozzle 120 disposed on one side end (forward end) of the side wall W1, and an igniter 122 disposed on a radially outward end of the side wall W1 for igniting. A plurality of pilot fuel nozzles 120 may be disposed symmetrically about the axis A1, such as being disposed circumferentially surrounding the axis A1. The secondary combustion zone 14 is nearer to the combustor exit 18 than the TV combustion zone 12. As used herein, term "downstream" means more proximate the combustor exit 18.

Figure 2:
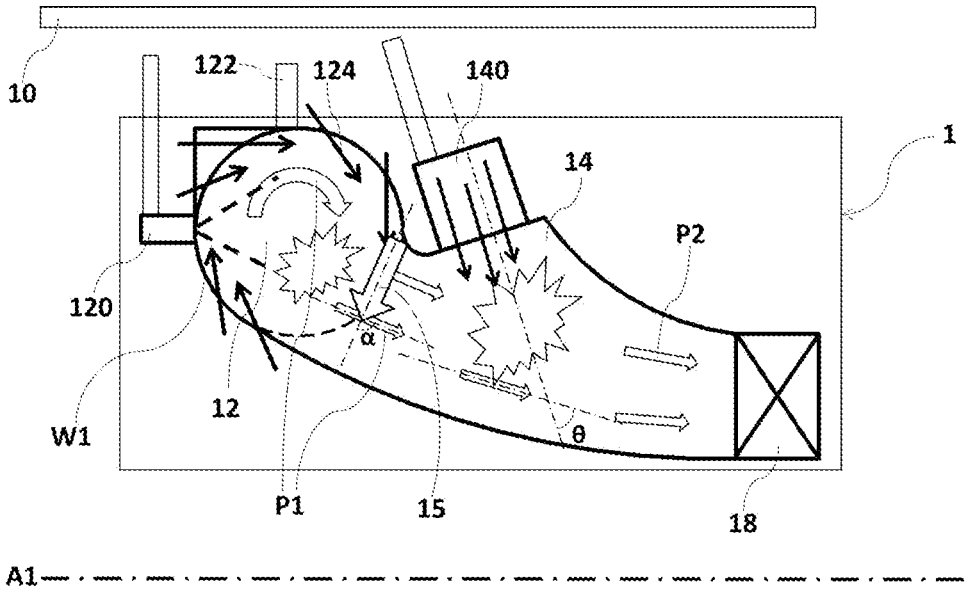
FIG. 2 is a schematic longitudinal partial cross-sectional diagram of a trapped vortex combustor in accordance with an embodiment of the disclosure.
Figure 3:
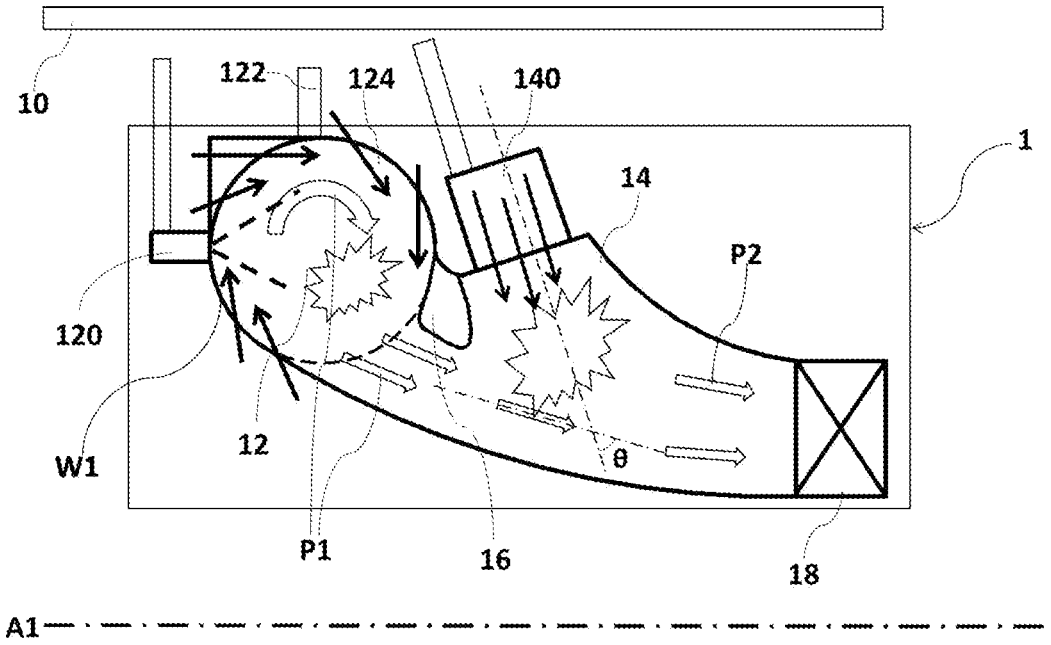
FIG. 3 is a schematic longitudinal partial cross-sectional diagram of a trapped vortex combustor in accordance with an embodiment of the disclosure.
Figure 4:
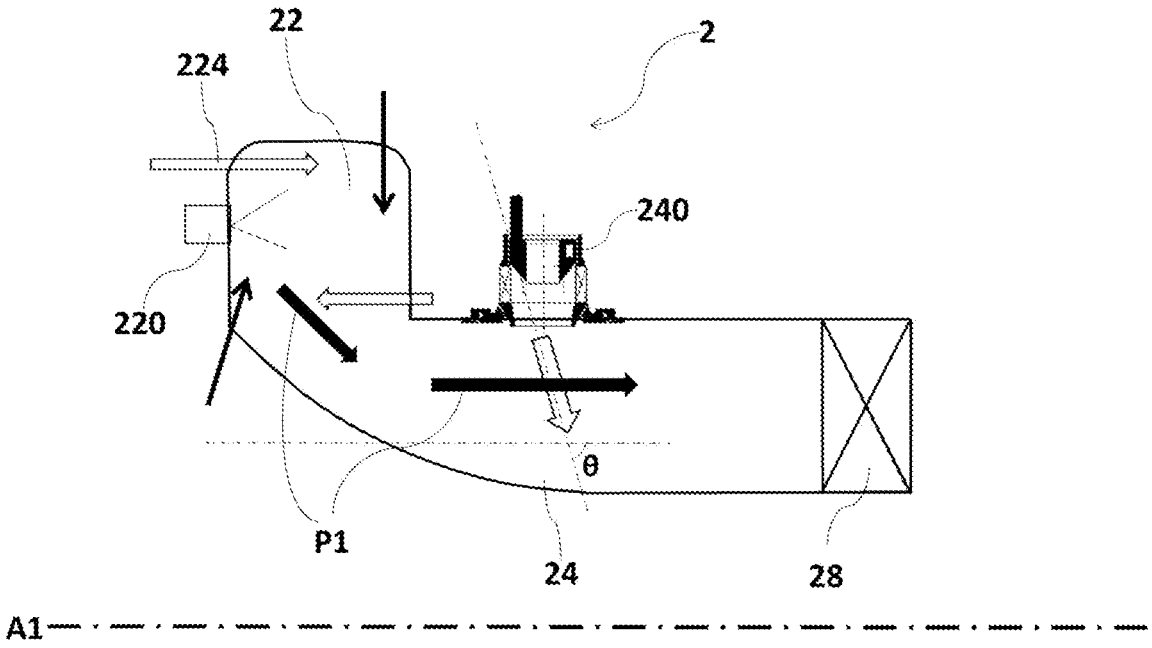
FIG. 4 is a schematic longitudinal partial cross-sectional diagram of a trapped vortex combustor in accordance with an embodiment of the disclosure.
Figure 6:
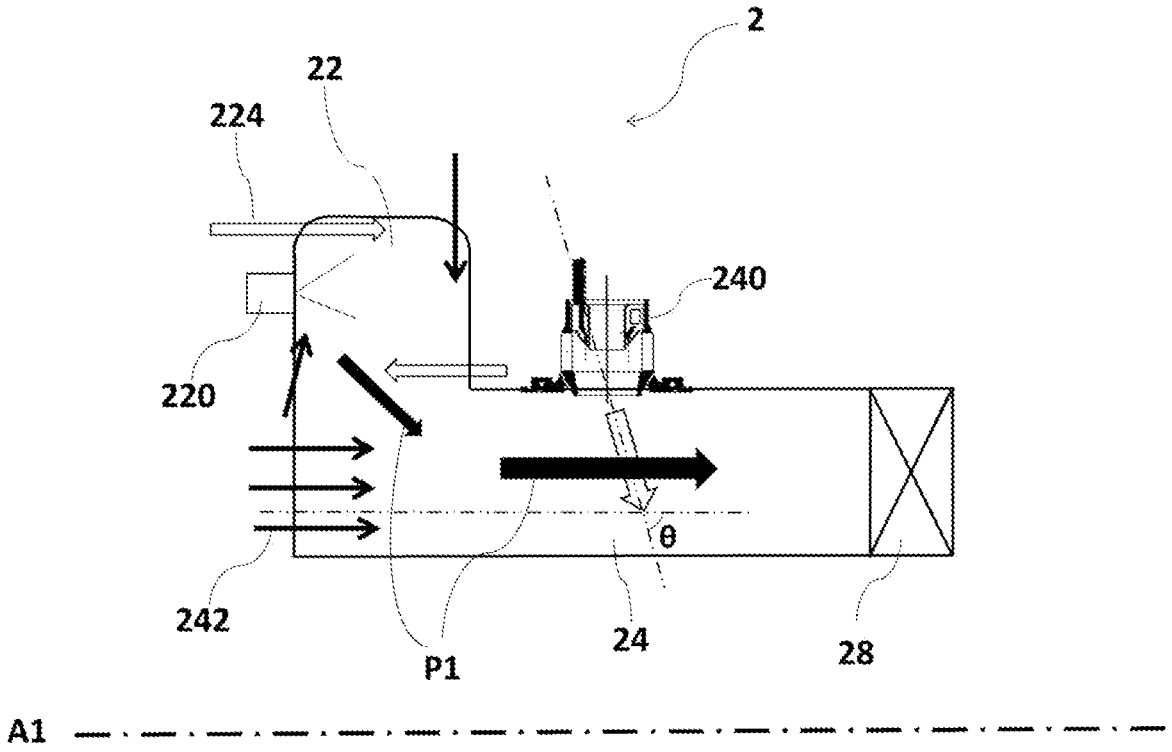
FIG. 6 is a schematic longitudinal partial cross-sectional diagram of a trapped vortex combustor in accordance with an embodiment of the disclosure.
Figure 7:
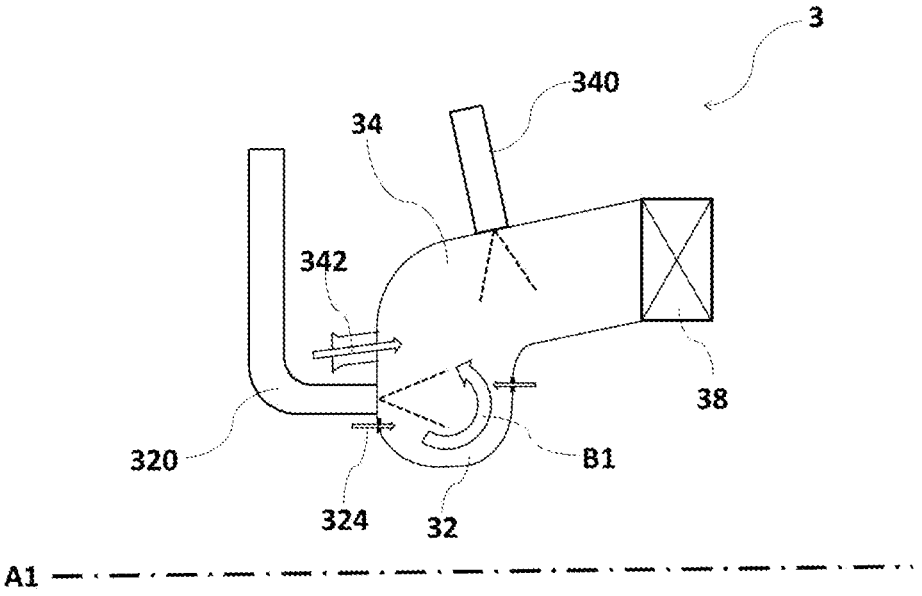
FIG. 7 is a schematic longitudinal partial cross-sectional diagram of a trapped vortex combustor in accordance with an embodiment of the disclosure.
Figure 8:
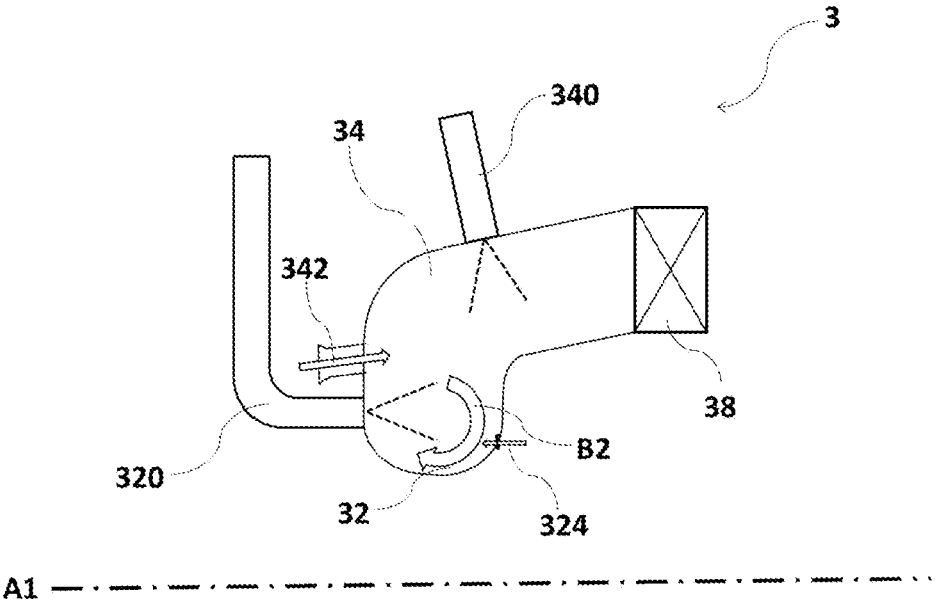
FIG. 8 is a schematic longitudinal partial cross-sectional diagram of a trapped vortex combustor in accordance with an embodiment of the disclosure.

As described above, the TV combustion zone 12 may have a substantially circular longitudinal cross-sectional shape depicted in FIGS. 1-3. In other exemplary embodiments, the TV combustion zone may be configured as substantially arcuate in longitudinal cross-section (as depicted in FIGS. 7 and 8) or substantially rectangular in longitudinal cross-section (as depicted in FIGS. 4-6).

The one or more pilot fuel nozzles 120 are operable to inject a first fuel (or reactant) into the TV combustion zone 12. The pilot fuel nozzle(s) 120 may be air-blast nozzle(s), pressure atomizer nozzle(s), plain jet orifice nozzle(s), or any other kinds of nozzles that one skilled in the art could conceive. The first fuel comprises a liquid fuel, a gaseous fuel and their combination, which can be selected from the usual fuels, such as jet fuel and any other kinds of fuel that any person skilled in the art could conceive. A first air 124 is a compressed air from a compressor (not shown) disposed upstream of the combustor 1, and the first air 124 is directed into the TV combustion zone or cavity 12 via a plurality of air apertures (not shown) formed through the wall W1 along a periphery of the TV combustion cavity 12, and flows toroidally and enhances the mixing effect with the first fuel.

The first fuel and the first air are received and mixed in the TV combustion zone 12, and combust onset by the spark of the igniter 122 and produce a first combustion product P1 flowing toroidally therein. In some embodiments, the TV combustion zone may be disposed substantially radially outside of the secondary combustion zone 14; as illustrated in FIGS. 1-3, only part of the TV combustion zone may be disposed substantially radially outside of the secondary combustion zone; optionally as illustrated in FIGS. 4-6, the whole TV combustion zone may be disposed substantially radially outside of the secondary combustion zone. In other exemplary embodiments, the TV combustion zone may be disposed radially inside of the secondary combustion zone, as depicted in FIGS. 7-8.

The secondary combustion zone 14 comprises at least one second fuel nozzle 140 for injecting the second fuel thereinto, and the secondary zone 14 is operable to receive and combust the first combustion product P1 and the second fuel and a second air also from the compressor and produce a second combustion product P2 therein. The second combustion product P2 is discharged out of the combustor 1 via the exit 18 if the combustor doesn't further comprise other combustion zone(s). The secondary combustion zone 14 may have a single second fuel nozzle 140. In an exemplary embodiment, the secondary combustion zone 14 may comprise a plurality of second fuel nozzles 140, such as two to thirty, which are symmetrically disposed circumferentially along an outside wall or liner of the secondary combustion zone 14. The second fuel nozzle(s) 140 may similarly be air-blast nozzle(s), pressure atomizer nozzle(s), plain jet orifice nozzle(s), or other suitable nozzles that one skilled in the art could conceive. In other embodiments, none of the second fuel nozzles 140 need to be provided or operated for injecting the second fuel, for example, when combusting in the TV combustion zone belongs to the rich fuel-air ratio combustion or under the other condition that the second fuel needn't be directly injected into the secondary combustion zone 14.

As illustrated in FIGS. 1-4, the one or more second fuel nozzles 140 are operable to inject the second fuel at an angle θ of from about 30° to about 90° (degrees) relative to the first combustion product P1 directed thereto. As illustrated in FIG. 1-4, the angle θ between the first combustion product P1 and the second fuel is about 30°-60°, more specifically, about 45°.

The second air may be set passively between about 10% and about 60% by weight or by volume of a combustor air comprising the first air and the second air, and the second fuel varies between about 0.1% and about 90% by weight or by volume of a combustor fuel comprising the first fuel and the second fuel. If there are other downstream combustion zone(s) rather than the secondary combustion zone 14, the above percentage amounts of the second air and the second fuel may have taken the amounts of the other downstream combustion zone(s) into account. The amount (or the ratio) of the first air, the second air, the first fuel and the second fuel may be selected or adjusted based on the condition of the gas turbine, such as load, delivery power, etc., so that combusting in the TV combustion zone and combusting in the secondary combustion zone each belongs to one of a lean fuel-air ratio combustion, a stoichiometric combustion, or a rich fuel-air ratio combustion over a spectrum of loads/conditions. The second air and/or the second fuel can be called as a second injection and needn't be limited to being directly supplied into the second combustion zone, and the second air or the second fuel may correspond to or come from an unspent counterpart of the first combustion product or an entrained counterpart (such as air injected by the air jet partitions 15 in FIG. 2) when the first combustion product flowing toward downstream or any other bypassed counterpart(s).

FIG. 2 shows an exemplary embodiment of the TV combustor 1. In order to simplify illustration and description, FIGS. 2-8 only illustrate the upper half of the combustor, the lower half portion (not shown) is basically the mirror structure of the illustrated upper half portion and can be understood by reference to the specifically described upper half potion. As depicted in FIG. 2, an air jet partition 15 is disposed between the TV combustion zone 12 and the secondary combustion zone 14, and the air jet partition 15 is operable to inject air and used for at least partly separating combusting in the TV combustion zone 12 from combusting in the secondary combustion zone 14. The air jet partition 15 may be configured as an air jet nozzle in various embodiments. In an exemplary embodiment, the jetting direction of the air jet partition 15 is at an angle α of about 60°-90° (degrees) relative to the first combustion product P1 just leaving the TV combustion zone 12. The TV combustion zone 12 is also configured as substantially circular in longitudinal cross-section similar to FIG. 1, the jetting direction of the air jet partition 15 may be substantially externally tangent to the TV combustion zone 12 with the substantially circular longitudinal cross sectional shape. The TV combustor 1 in FIG. 2 may comprise a plurality of air jet partitions 15 disposed circumferentially relative to the axis A1.

FIG. 3 shows an exemplary embodiment of the TV combustor 1. As depicted in FIG. 3, the TV combustor 1 further comprises a structural partition 16 comparing with the TV combustor 1 in FIG. 1. The structural partition 16 is disposed between the TV combustion zone 12 and the secondary combustion zone 14, more specifically disposed along the periphery of the TV combustion zone 12 with substantial circular cross-section shape, and the structural partition 16 is shaped with wedged cross-section and used for at least partly separating combusting in the TV combustion zone 12 from combusting in the secondary combustion zone 14. In an exemplary embodiment, the structural partition 16 may be made of metal, alloy materials or ceramic materials, or any other suitable material, which can be subject to high temperature of combustion.

FIG. 4 shows an exemplary embodiment of a TV combustor 2. The TV combustor 2 comprises a TV combustion zone 22, a secondary combustion zone 24 and a combustor exit 28, which substantially correspond to the similar components in FIG. 1 and can be understood by reference to the above description of FIG. 1. The secondary combustion zone 24 is disposed downstream of the TV combustion zone 22 mainly in axial direction and optionally in a radial direction and comprises one or more second fuel nozzles 240. As shown in FIG. 4, the TV combustion zone 22 is configured as substantially rectangular with a chamfered angle in a longitudinal cross-section. A first air 224 similarly from the compressor may be directed into the TV combustion zone 22 through opposite sides thereof, more specifically the first air 224 may be directed into the TV combustion zone 22 via a first plurality of air apertures (not shown) and an opposite second plurality of air apertures (not shown) substantially disposed on a diagonal line of the rectangular cross sectional shape of the TV combustion zone 22, thus the first air 224 flows toroidally therein. The first air 224 may be directed into the TV combustion zone 22 via a plurality of air apertures (not shown) formed along a periphery of the TV combustion zone or cavity 22 similar to FIGS. 1-3. The second fuel nozzle(s) 240 may comprise air blast nozzle(s), pressure atomizer nozzle(s), or plain jet orifice nozzle(s), or any other suitable nozzle. In exemplary embodiments, the second fuel nozzle(s) 240 may be air blast nozzle(s) as illustrated in FIG. 4.

FIG. 5 shows an exemplary embodiment of the TV combustor 2, the TV combustor 2 comprises a TV combustion zone 22, a secondary combustion zone 24 and a combustor exit 28 that can be understood by reference to the above description. The combustor 2 in FIG. 5 further comprises a tertiary combustion zone 27 disposed downstream of the secondary combustion zone 24 comparing with the combustor 2 illustrated in FIG. 4. Similarly, the tertiary combustion zone 27 comprises a third fuel nozzle 270 for injecting a third fuel, and is operable to receive and combust the second combustion product P2 and the third fuel and a third air and produce a third combustion product P3 therein, namely a sum of the combustion product and the fuel and the air before or upstream of the tertiary combustion zone 27 enter into the tertiary combustion zone 27 and mix with the third fuel and the third air and conduct combusting together. As shown in FIG. 5, the TV combustion zone 22 is also configured as substantially rectangular with a chamfered angle in longitudinal cross-section as shown FIG. 4. The third fuel nozzle 270 may similarly comprise one or more nozzles selected from an air blast nozzle, a pressure atomizer nozzle, or a plain jet orifice nozzle, or any other suitable nozzle. In exemplary embodiments, the third fuel nozzle 270 may be the air blast nozzle as illustrated in FIG. 5.

In other embodiments, none of the third fuel nozzle 270 need to be provided or operated for injecting the third fuel, for example, when combusting in the secondary combustion zone 24 belongs to the rich fuel-air ratio combustion or under the other condition that the third fuel needn't be directly injected into the tertiary combustion zone 27. Similarly, the third air and/or the third fuel can be called as a third injection and needn't be limited to being directly supplied into the tertiary combustion zone, and the third air or the third fuel may correspond to or come from an unspent or entrained counterpart of the first combustion product and/or the second combustion product or any other bypassed counterpart(s). Similar aft/downstream injection(s) consisting of air and/or fuel are injected into respective aft/downstream combustion zone(s) or stage(s) if provided.

In the combustor 2 of FIG. 5, a portion of the first combustion product P1, such as about 1%-60%, or about 2%-30% of its total amount, is introduced or directed into the tertiary combustion zone 27 without attending the combusting in the secondary combustion zone 24, namely leaking from or bypassing the secondary combustion zone 24, then mixes with the second combustion product P2 and the third fuel and the third air in the tertiary combustion zone 27 and combust together to form the third combustion product P3. Similarly, a portion of the second combustion product P2 may bypass the tertiary combustion zone 27 and attend combusting in the subsequent zone downstream of the tertiary combustion zone 27 if provided. Bypassing or leaking combustion product may happen in a fourth combustion zone or subsequent combustion zone(s) when further having one or more subsequent combustion zone(s) disposed downstream thereof. The amount of bypassing or leaking combustion product may be varied or adjusted based on the operating condition or parameters of the gas turbine, such as load, delivery power, etc.

FIG. 6 shows an exemplary embodiment of the TV combustor 2. The TV combustor 2 in FIG. 6 comprises a TV combustion zone 22, a secondary combustion zone 24 and a combustor exit 28, which substantially correspond to the similar components in FIGS. 1-5 and can be understood by reference to the above description of FIG. 1-5. The secondary combustion zone 24 is similarly disposed downstream of the TV combustion zone 22 and comprises a second fuel nozzle or second plurality of fuel nozzles 240, which can also be understood similarly as the above descriptions. As illustrated in FIG. 6, the second air 242 is introduced into the combustor 2 at the forward end of the combustor 2 and bypasses the TV combustion zone 22, and the second fuel nozzle or second plurality of fuel nozzles 240 is/are operable to inject the second fuel at an angle θ of from about 30° to 90° (degrees) relative to the second air 242. More specifically, the angle θ may be about 90 degrees, namely the second air may be introduced in the combustor 2 substantially parallel to the axis A1 of the gas turbine.

FIGS. 7 and 8 show some other exemplary embodiments of a TV combustor 3. The TV combustor 3 in FIGS. 7 and 8 each comprise a TV combustion zone 32, a secondary combustion zone 34 and a combustor exit 38, which substantially correspond to the similar components in FIGS. 1-5 and can be understood by reference to the above description of FIGS. 1-5. The difference between the TV combustor 3 in FIGS. 7-8 and the combustor in FIGS. 1-5 is the relative radial location of the TV combustion zone with respect to the secondary combustion zone, specifically as shown in FIGS. 7-8 the TV combustion zone 32 is wholly disposed radially inside of the secondary combustion zone 34, rather than radially outside of the secondary combustion zone in FIGS. 1-5. As shown in FIG. 7-8, the TV combustion zone 32 is configured as substantially arcuate in longitudinal cross-section. A first air 324 similarly from the compressor may be directed into the TV combustion zone 32 through diagonally opposite sides thereof similar to FIGS. 4-5, or via a plurality of air apertures (not shown) formed along a periphery of the TV combustion zone or cavity 32 similar to FIGS. 1-3. A second air 342 substantially similar to the second air 242 in FIG. 6 is introduced into the combustor 3 at the forward end of the combustor 3 and bypasses the TV combustion zone 32, which can be understood by reference to the above descriptions. The first air 324 and the first combustion product in the TV combustion zone or cavity 32 are each or both operable to flow in a clockwise direction (as indicted by arrow B2 in FIG. 8) or in a counterclockwise direction (as indicted by arrow B1 in FIG. 7) or a combination thereof (not shown, such as having two opposite direction trapped vortices flowing therein).

In operation, the combustor 1 or 2 or 3 utilizes the pilot fuel nozzle(s) 120 or 220 or 320 for introducing the first fuel in the TV combustion zone 12 or 22 or 32 to mix with the first air 124 or 224 or 324 from the compressor, the ignitor(s) (indicated by 122 in FIGS. 1-3) ignites the mixture of the first fuel and the first air; then the mixture combusts and produces a first combustion product P1 flowing toroidally in the TV combustion zone 12 or 22 or 32. Then the first combustion product P1 is directed downstream and into the secondary combustion zone 14 or 24 or 34 and mixed with the second fuel injected by the second nozzle(s) 140 or 240 or 340 and the second air therein, and the corresponding mixture combusts in the secondary combustion zone 14 or 24 or 34 and produces the second combustion product; as illustrated in FIGS. 1-4, 6-8, the second combustion product is discharged out of the combustor 1 or 2 or 3 via the combustor exit 18 or 28 or 38. As illustrated in FIG. 5, the second combustion product P2 is directed downstream and mixed with the third fuel injected by the third nozzle(s) 270 and the third air in the tertiary combustion zone 27 therein; the second combustion product P2 and the third fuel and the third air combust in the tertiary combustion zone 27 and produce the third combustion product P3 therein, and the third combustion product P3 is discharged out of the combustor 2 via the exit 28.

The combustor 1 or 2 or 3 as depicted in FIGS. 1-8 allows at least the second fuel to react downstream of the TV combustion zone. An advantage that may be realized in the practice of some embodiments of the described combustor and techniques is that the residence time of the highest temperature combustion products may be reduced, thus lower NOx emission levels overall may be achieved. At the same time, the TV combustion zone is extremely stable and allows for easy ignition and improves combustor turndown (low FAR) and efficiency. The downstream combustion zone(s) further prevents the TV combustion zone from being over-loaded in temperature and volumetric heat release as the gas turbine engine (and combustor) goes up in load. Also, the combustor 1 or 2 or 3 reduces the production of NOx by limiting the hottest flame temperatures (at the secondary combustion zone 14 or 24 or 34) to a shorter combustor residence time.

The combustor 1 or 2 or 3 can improve operational flexibility via optimized independent zones, such as the secondary combustion zone and/or the tertiary combustion zone. More compact overall combustor size can be achieved since main combustion or combusting can be occurred in the secondary combustion zone and the second fuel is burned in "hot" vitiated, the first combustion product.

Figure 9:
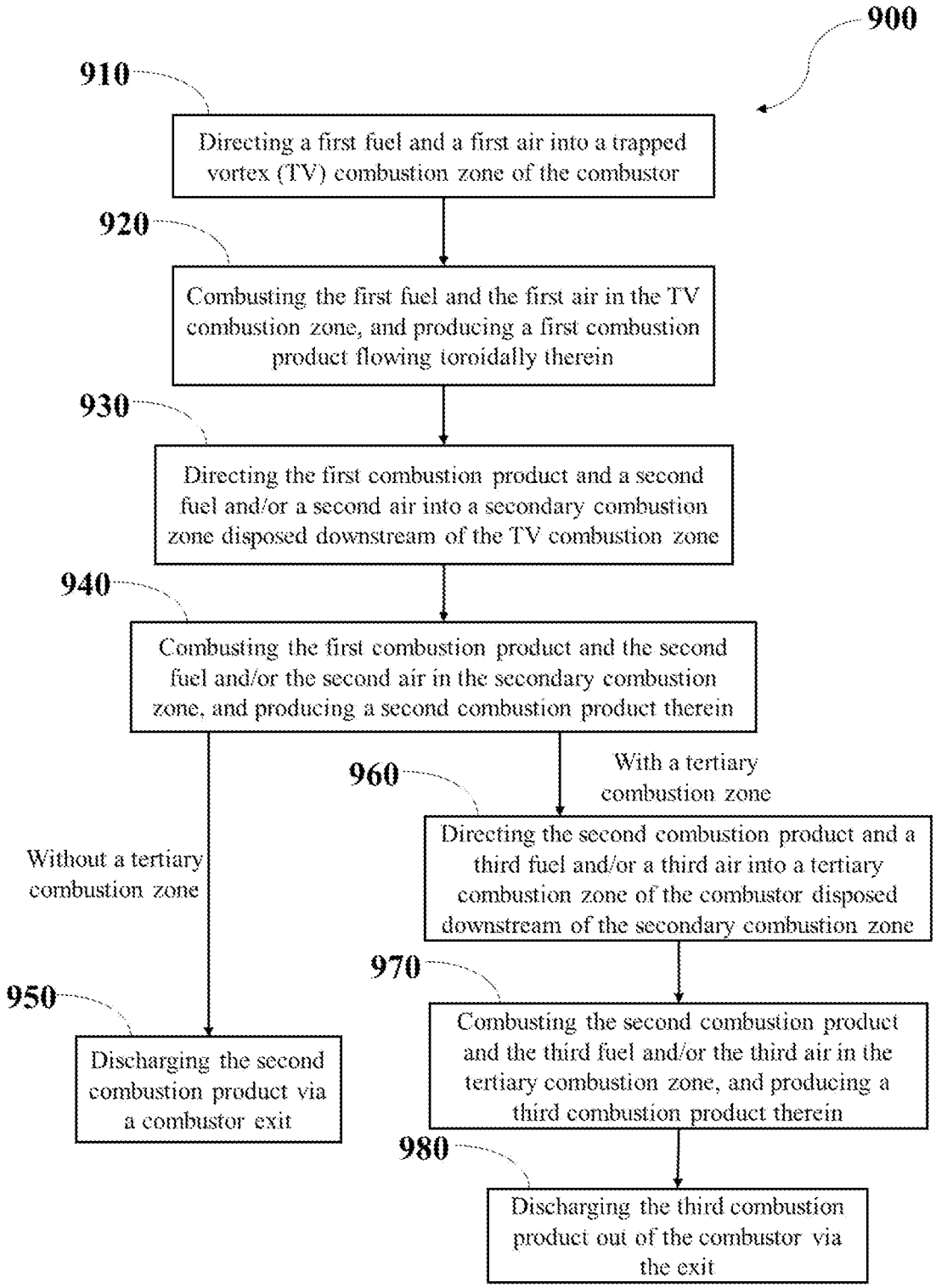
FIG. 9 is a flow chart illustrating a method for operating a trapped vortex combustor in accordance with an embodiment of the disclosure.

FIG. 9 illustrates an exemplary embodiment of a method 900 for operating a TV combustor comprising the TV combustor shown in FIGS. 1-8 and other similar combustors. Method 900 may be carried out by a controller, such as a combustion controller and the like. The controller may control the amount of air and/or fuel and the combustion product and other operation parameters to meet the demands or requirements of loads, the combustion mode/condition, the emission regulations, etc.

The method 900 begins at step 910 by directing a first fuel and a first air into a trapped vortex (TV) combustion zone of the combustor. As illustrated in above description and embodiments, the TV combustor is configurable to be an annular combustor, and the TV combustion zone may be shaped as a TV combustion cavity and configured as arcuate in longitudinal cross-section (as illustrated in FIG. 7-8), or rectangular with a chamfered angle in longitudinal cross-section (as illustrated in FIG. 4-6), or substantially circular in longitudinal cross-section (as illustrated in FIG. 1-3).

As descried above, the first air may be a compressed air from a compressor disposed upstream of the combustor, and the first air is directed into the cavity from a plurality of primary air apertures (not shown) formed along a periphery or on opposite sides of the TV combustion cavity and flows toroidally and enhances the mixing effect with the first fuel.

The method 900 further comprises combusting the first fuel and the first air in the TV combustion zone and producing a first combustion product flowing toroidally therein at step 920; the combusting in the TV combustion zone may belong to one of a lean fuel-air ratio combustion, a stoichiometric combustion, or a rich fuel-air ratio combustion, and the specific combustion mode or type depends on the above-mentioned loads and other conditions and emission regulations, etc.

The method 900 further comprises directing the first combustion product and a second fuel and/or a second air into a secondary combustion zone disposed downstream of the TV combustion zone at step 930. The second air may be introduced into the secondary combustion zone by bypassing the TV combustion zone as illustrated in FIG. 6, or introduced thereinto in a manner that any person skilled in the art could conceive, such as injecting around or towards the second fuel nozzle at an acute angle relative to the second fuel. The secondary combustion zone may be provided with one or more second fuel nozzle(s) for injecting the second fuel at an angle of from about 30 to 90 degrees relative to the second air or the first combustion product directed thereinto as described above. The second air and/or the second fuel can be called as a second injection and needn't be limited to being directly supplied into the second combustion zone, and the second air or the second fuel may correspond to or come from an unspent counterpart of the first combustion product or an entrained counterpart when the first combustion product flowing toward downstream or any other bypassed counterpart(s).

The second air is set passively between about 10% and about 60% by weight or by volume of a combustor air comprising the first air and the second air, and the second fuel varies between about 0.1% and about 90% by weight or by volume of a combustor fuel comprising the first fuel and the second fuel. If there are other downstream combustion zone(s) rather than the secondary combustion zone 14, the above percentage amounts the second air and the second fuel may have taken the amounts of the other downstream combustion zone(s) into account. As described above the specific amount or ratio or percent of the second air and the second fuel depend on the operation conditions, loads, other parameters, etc. The second fuel or the first fuel may be a liquid fuel and a gaseous fuel, or any other suitable fuel. The TV combustion zone is disposed radially outside of the secondary combustion zone (by referring to FIG. 1-6) or disposed radially inside of the secondary combustion zone (by referring to FIG. 7-8).

The method 900 further comprises combusting the first combustion product and the second fuel and/or the second air in the secondary combustion zone and producing a second combustion product therein at step 940. At step 940 combusting in the secondary combustion zone may belong to one of a lean fuel-air ratio combustion, a stoichiometric combustion, or a rich fuel-air ratio combustion. The specific combustion mode or type also depends on the above-mentioned loads, other operation conditions and emission regulations, etc.

The method 900 further comprises discharging the second combustion product via a combustor exit at step 950, if the combustor merely has single secondary combustion zone; namely the combustor comprises only the TV combustor and the secondary combustion zone without a tertiary combustion zone. If the combustor has more than one secondary combustion zone, such as the combustor further comprising a tertiary combustion zone disposed downstream of the secondary combustion zone as illustrated in FIG. 5, the method 900 further comprises directing the second combustion product and a third fuel and/or a third air into a tertiary combustion zone of the TV combustor disposed downstream of the secondary combustion zone at step 960 rather than proceeding step 950, prior to discharging the second combustion product out of the combustor; namely if the combustor has more than one combustion zone downstream of the TV combustion zone, the method 900 directly proceeds step 960 rather than step 950.

Similarly, the third air and/or the third fuel can be called as a third injection and needn't be limited to being directly supplied into the tertiary combustion zone, and the third air or the third fuel may correspond to or come from an unspent or entrained counterpart of the first combustion product and/or the second combustion product or any other bypassed counterpart(s).

The method 900 further comprises combusting the second combustion product and the third fuel and/or the third air in the tertiary combustion zone and producing at least one third combustion product therein at step 970, subsequent to step 960, namely a sum of the combustion product and the fuel and/or the air before or upstream of the tertiary combustion zone enter into the tertiary combustion zone and mix with the third fuel and/or the third air and conduct combusting together.

The method 900 further comprises discharging the third combustion product out of the combustor via the exit at step 980.

If the combustor further comprises more other combustion zone(s), the method 900 could proceed or repeat steps 960-970 to complete all stage(s) of combusting prior to proceed step 980 and discharging the last combustion product out of the combustor.

Various embodiments allow the relatively downstream combustion zones to combust or fire at a higher temperature than the relatively upstream combustion zones when in near-full-load operation. This also allows the highest temperature combustion products to have the shortest stay in the combustor, consequently, producing less NOx for the total combustor.

In one embodiment, a trapped vortex combustor comprises: a trapped vortex combustion zone operable to receive and combust a first fuel and a first air and produce a first combustion product flowing toroidally therein; and at least one secondary combustion zone disposed downstream of the trapped vortex combustion zone, and operable to receive and combust the first combustion product and at least one second injection consisting of fuel and/or air and produce at least one second combustion product therein.

In one example, the combustor further comprises a combustor exit, wherein the at least one secondary combustion zone is located nearer to the combustor exit than the trapped vortex combustion zone.

In one example, the trapped vortex combustion zone is disposed radially outside of the at least one secondary combustion zone.

In one example, the trapped vortex combustion zone is disposed radially inside of the at least one secondary combustion zone.

In one example, the at least one secondary combustion zone comprises a secondary combustion zone and at least one tertiary combustion zone disposed downstream of the secondary combustion zone, and the at least one tertiary combustion zone is operable to receive and combust the at least one second combustion product and at least one third injection consisting of fuel and/or air and produce at least one third combustion product therein.

In one example, the trapped vortex combustor comprises an annular combustor, and the trapped vortex combustion zone is configured as arcuate or rectangular or circular in cross-section.

In one example, an air jet partition is disposed between the trapped vortex combustion zone and the at least one secondary combustion zone, and the air jet partition is operable to jet air for separating combusting in the trapped vortex combustion zone from combusting in the at least one secondary combustion zone.

In one example, a structural partition is disposed between the trapped vortex combustion zone and the at least one secondary combustion zone, and the structural partition is utilized for separating combusting in the trapped vortex combustion zone from combusting in the at least one secondary combustion zone.

In one example, the trapped vortex combustion zone is configured as a trapped vortex combustion cavity, and the first air is directed into the trapped vortex combustor along a periphery of the trapped vortex combustion cavity.

In another example, at least one of the first air and the first combustion product in the trapped vortex combustion cavity is operable to flow in a clockwise direction or in a counterclockwise direction or a combination thereof.

In another embodiment, a method for operating a trapped vortex combustor, the method comprises: directing a first fuel and a first air into a trapped vortex combustion zone of the combustor; combusting the first fuel and the first air in the trapped vortex combustion zone and producing a first combustion product flowing toroidally therein; directing the first combustion product and at least one second injection consisting of fuel and/or air into at least one secondary combustion zone of the combustor disposed downstream of the trapped vortex combustion zone; combusting the first combustion product and the at least one second injection consisting of fuel and/or air in the at least one secondary combustion zone and producing at least one second combustion product therein; and directing the at least one second combustion product towards a combustor exit of the combustor for discharging out of the combustor.

In one example, wherein the trapped vortex combustion zone is disposed radially outside of the at least one secondary combustion zone or disposed radially inside of the at least one secondary combustion zone.

In one example, the trapped vortex combustor comprises an annular combustor, and the trapped vortex combustion zone is configured as arcuate or rectangular or circular in cross-section.

In one example, the method further comprises separating combusting in the trapped vortex combustion zone from combusting in the at least one secondary combustion zone via a structural partition or an air jet partition disposed between the trapped vortex combustion zone and the at least one secondary combustion zone, wherein the air jet partition is operable to jet air for separating combusting in the trapped vortex combustion zone from combusting in the at least one secondary combustion zone.

In one example, the trapped vortex combustion zone is configured as a trapped vortex combustion cavity, and the first air is directed into the trapped vortex combustor along a periphery of the trapped vortex combustion cavity.

In another example, at least one of the first air and the first combustion product in the trapped vortex combustion cavity is operable to flow in a clockwise direction or in a counterclockwise direction or a combination thereof.

In one example, the method further comprises: directing the at least one second combustion product and at least one third injection consisting of fuel and/or air into at least one tertiary combustion zone of the combustor disposed downstream of the secondary combustion zone; combusting the at least one second combustion product and the at least one third injection consisting of fuel and/or air in the at least one tertiary combustion zone and producing at least one third combustion product therein; and directing the at least one third combustion product towards the exit for discharging out of the combustor.

In one example, the at least one second injection comprises at least one second air and/or at least one second fuel, and the at least one second air bypasses the trapped vortex combustion zone, and the at least one secondary combustion zone is provided with at least one second fuel nozzle for injecting the at least one second fuel at an angle of from about 30 to 90 degrees relative to the at least one second air or the first combustion product directed into the at least one secondary combustion zone, and wherein the at least one second fuel comprises a liquid fuel and a gaseous fuel.

In one example, the at least one second injection comprises at least one second air and/or at least one second fuel, and the at least one second air is set between about 10% and about 60% by weight or by volume of a combustor air comprising the first air and the at least one second air, and the second fuel varies between about 0.1% and about 90% by weight or by volume of a combustor fuel comprising the first fuel and the at least one second fuel.

In one example, wherein combusting in the trapped vortex combustion zone and combusting in the at least one secondary combustion zone each belongs to one of a lean fuel-air ratio combustion, a stoichiometric combustion, or a rich fuel-air ratio combustion.

While the disclosure has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the disclosure may include only some of the described embodiments. Accordingly, the invention is not to be seen as limited by the foregoing description, but is only limited by the scope of the appended claims.

This written description, which includes the best mode, uses examples to disclose the invention and to enable any person skilled in the art to practice the invention, including making and using any devices or systems and performing any incorporated methods. The patentable scope of the invention is defined by the claims, and may include other examples that occur to those skilled in the art. Such other examples are intended to fall within the scope of the claims if they include structural elements that do not differ from the literal language of the claims, or if they include equivalent structural elements with insubstantial differences from the literal language of the claims.

What is claimed is:

1. A trapped vortex combustor defining an axial direction, a radial direction, and a circumferential direction, the trapped vortex combustor comprising:

a trapped vortex annular wall including a forward wall portion, an axially extending wall portion and an aft wall portion, a forward end of the trapped vortex combustor having a forward end wall including the forward wall portion, the trapped vortex annular wall defining a trapped vortex combustion zone operable to receive a first fuel flow from at least one first fuel nozzle disposed in the forward wall portion and a first air flow, to generate a fuel and air mixture from the first fuel flow and the first air flow, to combust the fuel and air mixture and to produce first combustion products therein, the first air flow directed into the trapped vortex combustion zone at a plurality of axial and radial locations along a periphery of the trapped vortex annular wall in a plurality of directions, such that the first air flow flows toroidally within the trapped vortex combustion zone to thereby cause the first combustion products to flow toroidally therein, the forward end of the trapped vortex combustor having fuel injection only through the at least one first fuel nozzle disposed in the forward wall portion;

an ignitor disposed in the trapped vortex combustion zone operable to ignite the fuel and air mixture in the trapped vortex combustion zone;

at least one secondary combustion fuel nozzle that is disposed on a radially outer wall of the trapped vortex combustor axially downstream of the trapped vortex combustion zone, the at least one secondary combustion fuel nozzle directed in a direction that forms an acute angle with respect to the axial direction and operable to inject at least one second fuel flow; and at least one secondary combustion zone disposed axially downstream of the trapped vortex combustion zone, and operable to receive and to combust the first combustion products and the at least one second fuel flow injected from the at least one secondary combustion fuel nozzle and to produce second combustion products therein, wherein the trapped vortex annular wall is disposed one of (i) radially outward of the radially outer wall of the trapped vortex combustor or (ii) radially inward of the radially outer wall of the trapped vortex combustor.

2. The trapped vortex combustor of claim 1, further comprising a combustor exit, wherein the at least one secondary combustion zone is located nearer to the combustor exit than to the trapped vortex combustion zone.

3. The trapped vortex combustor of claim 1, wherein the at least one secondary combustion zone comprises a secondary combustion zone and at least one tertiary combustion zone disposed downstream of the secondary combustion zone, and the at least one tertiary combustion zone is operable to receive and to combust the second combustion products and at least an additional fuel flow or an additional air flow and to produce third combustion products therein.

4. The trapped vortex combustor of claim 1, wherein the trapped vortex combustor comprises an annular combustor, and the trapped vortex combustion zone is configured as arcuate, rectangular, or circular in cross section.

5. The trapped vortex combustor of claim 1, wherein the trapped vortex combustion zone is configured as a trapped vortex combustion cavity, and the first air flow is directed into the trapped vortex combustor along a periphery of the trapped vortex combustion cavity.

6. The trapped vortex combustor of claim 5, wherein at least one of the first air flow or the first combustion products in the trapped vortex combustion cavity is operable to flow in a clockwise direction or in a counterclockwise direction.

7. The trapped vortex combustor of claim 1, wherein the acute angle is a first acute angle, and the at least one secondary combustion fuel nozzle is operable to inject the at least one second fuel flow at a second acute angle between thirty and ninety degrees relative to the first combustion products.

8. The trapped vortex combustor of claim 7, wherein the second acute angle is between thirty and sixty degrees.

9. The trapped vortex combustor of claim 1, wherein the acute angle is a secondary fuel injection angle, and the first combustion products exiting the trapped vortex combustion zone form a trapped vortex exit acute angle with respect to the axial direction.

10. The trapped vortex combustor of claim 1, wherein the ignitor that is operable to ignite the fuel and air mixture in the trapped vortex combustion zone is disposed in the trapped vortex annular wall defining the trapped vortex combustion zone.

11. A trapped vortex combustor defining an axial direction, a radial direction, and a circumferential direction, the trapped vortex combustor comprising:

a trapped vortex annular wall including a forward wall portion, an axially extending wall portion and an aft wall portion, a forward end of the trapped vortex combustor having a forward end wall including the forward wall portion, the trapped vortex annular wall defining a trapped vortex combustion zone operable to receive a first fuel flow from at least one first fuel nozzle disposed in the forward wall portion and a first air flow, to generate a fuel and air mixture from the first fuel flow and the first air flow, to combust the fuel and air mixture and to produce first combustion products therein, the first air flow directed into the trapped vortex combustion zone at a plurality of axial and radial locations along a periphery of the trapped vortex annular wall in a plurality of directions, such that the first air flow flows toroidally within the trapped vortex combustion zone to thereby cause the first combustion products to flow toroidally therein, the forward end of the trapped vortex combustor having fuel injection only through the at least one first fuel nozzle disposed in the forward wall portion;

an ignitor disposed at the trapped vortex combustion zone operable to ignite the fuel and air mixture in the trapped vortex combustion zone;

at least one secondary combustion fuel nozzle that is disposed on a radially outer wall of the trapped vortex combustor axially downstream of the trapped vortex combustion zone, the at least one secondary combustion fuel nozzle operable to inject at least one second fuel flow at an angle of between thirty and sixty degrees with respect to the first combustion products; and at least one secondary combustion zone disposed axially downstream of the trapped vortex combustion zone, and operable to receive and to combust the first combustion products and the at least one second fuel flow injected from the at least one secondary combustion fuel nozzle and to produce second combustion products therein, wherein the trapped vortex annular wall is disposed one of (i) radially outward of the radially outer wall of the trapped vortex combustor or (ii) radially inward of the radially outer wall of the trapped vortex combustor.

12. The trapped vortex combustor of claim 11, wherein the first combustion products exit the trapped vortex combustion zone at an acute angle with respect to the axial direction defined by the trapped vortex combustor.

13. The trapped vortex combustor of claim 11, wherein the ignitor that is operable to ignite the fuel and air mixture in the trapped vortex combustion zone is disposed in the trapped vortex annular wall defining the trapped vortex combustion zone.

* * * * *